US007100557B2

(12) United States Patent
Takezoe

(10) Patent No.: US 7,100,557 B2
(45) Date of Patent: Sep. 5, 2006

(54) ENGINE START CONTROL SYSTEM AND CONTROL METHOD

(75) Inventor: Hiroshi Takezoe, Atsugi (JP)

(73) Assignee: Nissan Motor Co., Ltd., Kanagawa-Ken (JP)

( * ) Notice: Subject to any disclaimer, the term of this patent is extended or adjusted under 35 U.S.C. 154(b) by 0 days.

(21) Appl. No.: 11/157,162

(22) Filed: Jun. 21, 2005

(65) Prior Publication Data

US 2005/0284436 A1 Dec. 29, 2005

(30) Foreign Application Priority Data

Jun. 21, 2004 (JP) ..... P2004-182020

(51) Int. Cl.
*F02N 11/08* (2006.01)
*F02N 11/12* (2006.01)

(52) U.S. Cl. ..... 123/179.2; 307/10.6

(58) Field of Classification Search ..... 123/179.2, 123/179.3, 179.4; 307/9.1, 10.1, 10.2, 10.3, 307/10.6; 340/426.13, 426.17, 426.3, 5.2, 340/5.72, 5.64; 74/6, 7 R; 180/287
See application file for complete search history.

(56) References Cited

U.S. PATENT DOCUMENTS 6,573,615 B1 * 6/2003 Asakura et al. ..... 307/9.1
6,639,511 B1 * 10/2003 Haruna et al. ..... 340/426.13
6,801,120 B1 * 10/2004 Hara ..... 340/5.72
6,982,632 B1 * 1/2006 Nagasaka et al. ..... 340/426.3
2001/0028297 A1 * 10/2001 Hara et al. ..... 340/5.2
2004/0168663 A1 * 9/2004 Matsuura et al. ..... 123/179.2
2004/0183653 A1 * 9/2004 Hata ..... 340/5.64
2004/0262068 A1 * 12/2004 Matsubara et al. ..... 180/287
2005/0029871 A1 * 2/2005 Mori et al. ..... 307/10.3
2005/0258686 A1 * 11/2005 Hiramitsu et al. ..... 307/10.1

FOREIGN PATENT DOCUMENTS

JP 10122104 A * 5/1998 ..... 307/9.1
JP 2001073910 A * 3/2001 ..... 307/9.1
JP 2003-254113 9/2003
JP 2003301764 A * 10/2003 ..... 307/9.1
JP 2004314906 A * 11/2004 ..... 307/9.1

* cited by examiner

*Primary Examiner*—Willis R. Wolfe, Jr.
(74) *Attorney, Agent, or Firm*—McDermott Will & Emery LLP

(57) ABSTRACT

An engine start control system of the present invention has a power supply controller which includes an ignition power supply relay activating an electric component of a vehicle and a central processing unit controlling the ignition power supply relay, a communication device communicating with a portable unit to authenticate a validity of the portable unit and performing engine start control. Further, the engine start control system has the a first drive line provided between the communication device and the ignition power supply relay and not routed through the central processing unit. By this structure, the system can obtain redundancy.

7 Claims, 2 Drawing Sheets

ENGINE START CONTROL SYSTEM AND CONTROL METHOD

BACKGROUND OF THE INVENTION

1. Field of the Invention

The present invention relates to an engine start control system and an engine start control method.

2. Description of the Related Art

The Japanese Patent Laid-Open Publication No. 2003-254113 describes an engine start control system for improving operability of a vehicle. This engine start control system includes functions to control an ignition power supply, control start/stop of an engine, control an accessory power supply, and control locking/unlocking of steering. Furthermore, this engine start control system is capable of independently carrying out start/stop operations of the engine and a locking operation of a steering lock.

SUMMARY OF THE INVENTION

However, in the engine start control system of the above gazette, the functions to control the ignition power supply, control start/stop of the engine, control the accessory power supply, and control locking/unlocking of steering are integrated in a single unit. A failure of this unit could not therefore reduce the integrity involving the function to start/stop the engine.

The present invention is made in view of the above problems, and an object of the present invention is to provide engine start control system and method with redundancy.

The first aspect of the present invention provides an engine start control system comprising: a power supply controller which includes: an ignition power supply relay activating an electric component of a vehicle; and a central processing unit controlling the ignition power supply relay; a communication device communicating with a portable unit to authenticate a validity of the portable unit and performing engine start control; and a first drive line provided between the communication device and the ignition power supply relay and not routed through the central processing unit.

The second aspect of the present invention provides an engine start control method comprising: preparing a power supply controller which includes an ignition power supply relay activating an electric component of a vehicle and a central processing unit controlling the ignition power supply relay, a communication device which communicates with a portable unit to authenticate a validity of the portable unit and performing engine start control, and a drive line which is provided between the communication device and the ignition power supply relay and is not routed through the central processing unit, and transmitting a signal to activate the electric component from the communication device to the ignition power supply relay using the drive line when the power supply controller fails.

The third aspect of the present invention provides an engine start control system comprising: power supply controlling means which includes: an ignition power supply relay activating an electric component of a vehicle; and a central processing unit controlling the ignition power supply relay; communication means for communicating with a portable unit to authenticate a validity of the portable unit and performing engine start control; and a first drive line provided between the communication means and the ignition power supply relay and not routed through the central processing unit.

BRIEF DESCRIPTION OF THE DRAWINGS

The invention will now be described with reference to the accompanying drawings wherein.

DETAILED DESCRIPTION OF THE PREFERRED EMBODIMENT

Figure 1:
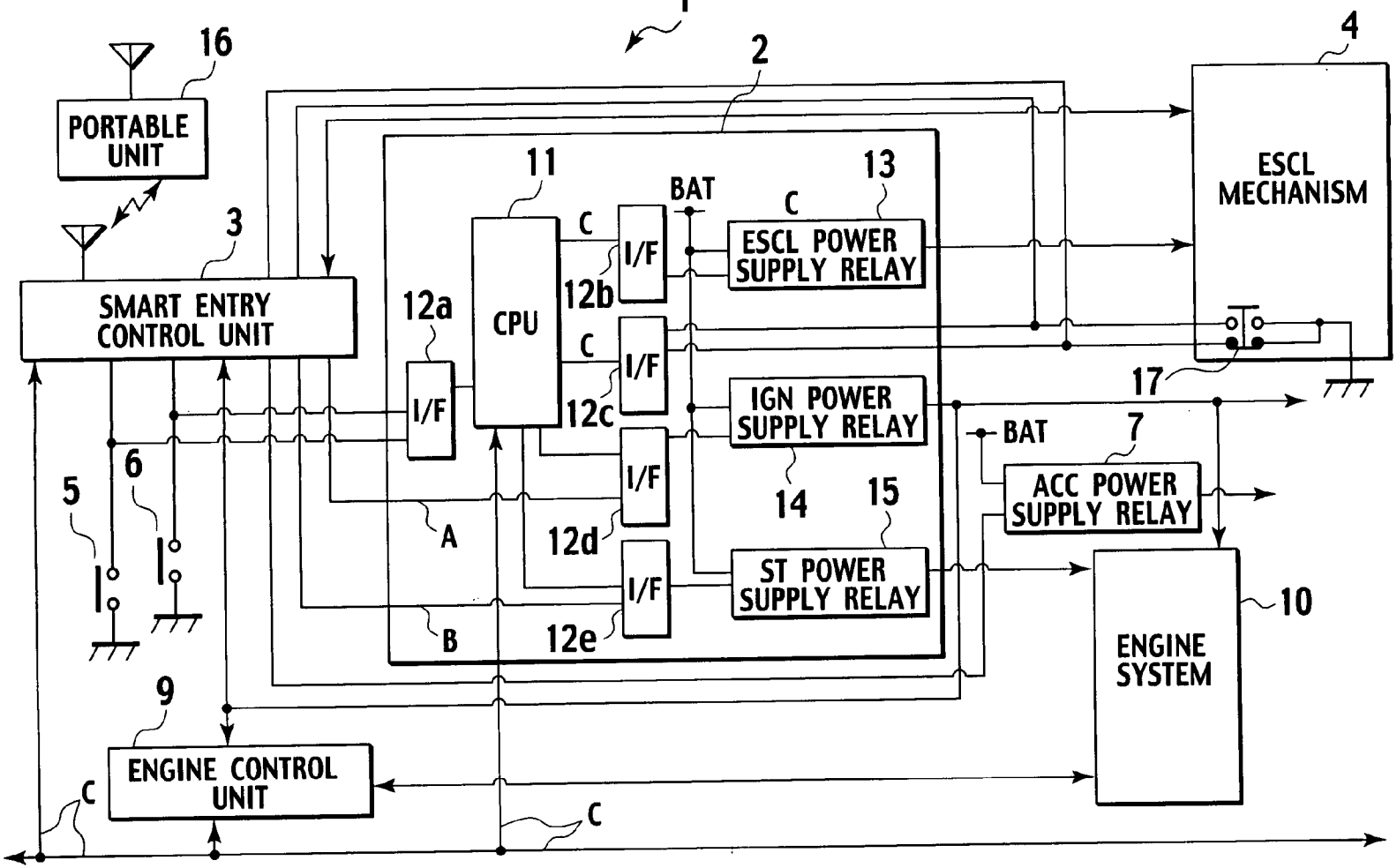
FIG. 1 is a diagram showing a system configuration of an engine start control system of a first embodiment of the present invention.

Hereinafter, a description is given of embodiments of the present invention in detail using the drawings. In the drawings described later, components having same functions are given same reference numerals, and redundant descriptions thereof are omitted.

(First Embodiment)

FIG. 1 shows a system configuration of an engine start control system of a first embodiment of the present invention.

In FIG. 1, reference numeral 1 indicates an engine start control system; 16, a portable unit; 3, a smart entry control unit; 2, a power supply control unit; 4, an electric power steering column lock mechanism (ESCL mechanism); 5, an engine on/off switch; 6, a shift P range switch; 9, an engine control unit; 10, an engine system; 11, a central processing unit (CPU); 12*a*, 12*b*, 12*c*, 12*d* and 12*e*, interface circuits; 14, an ignition power supply relay (IGN power supply relay); 15, a starter power supply relay (ST power supply relay); 13, an ESCL power supply relay; 7, an accessory power supply relay (ACC power supply relay); 17, an electric power steering column lock state detection switch (ESCL state detection switch); A, an IGN power supply relay drive line; B, a ST power supply relay drive line; C, a multiplex communication line; and BAT, a battery.

As shown in FIG. 1, the engine start control system 1 includes the portable unit 16, the power supply control unit 2, the smart entry control unit 3, the ESCL mechanism 4, the engine on/off switch 5, the shift P range switch 6, and the ACC power supply relay 7.

The portable unit 16 communicates with the smart entry control unit 3 and performs authentication in conjunction with the smart entry control unit 3. The power supply control unit 2 controls each power supply, that is, an IGN power supply, a ST power supply, and an ESCL power supply. The smart entry control unit 3 controls locking/unlocking of doors, verifies a key, controls permission to start the engine, and controls the power supplies. The ESCL mechanism 4 controls locking/unlocking of an electric power steering column. The engine on/off switch 5 is operated to instruct the power supply control unit 2 to start/stop the engine, to lock/unlock the ESCL, and to turn on/off the IGN power supply and ACC power supply. The shift P range switch 6 detects a P (parking) range position of a shift lever of a transmission.

The power supply control unit 2 includes the CPU 11, the interface circuits 12*a* to 12*e*, the ESCL power supply relay 13, the IGN power supply relay 14, and the ST power supply relay 15. The ESCL mechanism 4 includes the ESCL state detection switch 17 to detect the state of an electrically-driven lock rod with which the steering column is locked/unlocked.

The portable unit 16 is carried by the occupant, and communicates with the smart entry control unit 3 for authentication. When the smart entry control unit 3 authenticates the validity of the portable unit 16, the smart entry control unit 3 gives the engine control unit 9 permission to start the engine. Furthermore, in this case, the smart entry control unit 3 gives the power supply control unit 2 permission to start the engine and also gives permission to supply ignition power and permission to release the ESCL. In this case, the smart entry control unit 3 gives the ESCL mechanism 4 permission to release the ESCL.

Upon receiving the permission to start the engine from the smart entry control unit 3, the engine control unit 9 goes into an engine start preparatory state. The ST power supply relay 15 of the power supply control unit 2 supplies electric power to operate a starter motor within the engine system 10, thus starting the engine.

Upon receiving the permission to start the engine from the smart entry control unit 3, the power supply control unit 2 turns on the ST power supply relay 15 according to the state of the engine on/off switch 5, the state of the shift P range switch 6, vehicle speed transmitted on the multiplex communication line C, vehicle information such as engine rotation speed, and the state of the ESCL state detection switch 17. The engine is thus started.

Upon receiving the permission to supply IGN power from the smart entry control unit 3, the power supply control unit 2 turns on the IGN power supply relay 14 to activate electric components of the vehicle. Upon receiving the permission to release the ESCL from the smart entry control unit 3, the power supply control unit 2 turns on the ESCL power supply relay 13 according to the state of the engine on/off switch 5, the state of the shift P range switch 6, the vehicle speed transmitted on the multiplex communication line C, the vehicle information such as the engine rotation speed, and the states of the ESCL state detection switch 17 and ST power supply relay 15. This allows locking/unlocking of the ESCL.

Upon receiving the permission to release the ESCL from the smart entry control unit 3, the ESCL mechanism 4 goes into a mode capable of locking/unlocking the ESCL according to the state of the ESCL state detection switch 17.

Next, a description is given of an action when a system component fails, which is a characteristic of this embodiment.

When the power supply control unit 2 fails, for example, when the CPU 11 fails, in the conventional device of the aforementioned literature or the like, all the IGN power supply relay 14, ACC power supply relay 7, ST power supply relay 15, ESCL power supply relay 13, and ESCL mechanism 4 cannot work. Accordingly, the vehicle stops and cannot restart, and fault diagnosis cannot be carried out. This makes it very hard to locate the fault and move the disabled vehicle.

On the other hand, the engine start control system of the first embodiment is configured as shown in FIG. 1. Even when the CPU 11 of the power supply control unit 2 fails, therefore, the IGN and ST power supply relays 14 and 15 can be operated through the IGN and ST power supply relay drive lines A and B, respectively, according to the states of the above peripheral switches and the state of the signals on the multiplex communication line C, which allows travel of the vehicle. Moreover, the fault diagnosis can be carried out using a fault diagnosis device connected to or incorporated in the engine start control system 1. Accordingly, reliability of the vehicle can be improved, and speeding up trouble-shooting and reducing the number of renewal parts can reduce repair cost.

As described above, the engine start control system of the first embodiment includes the power supply control unit 2, which has the IGN power supply relay 14 and the CPU 11 controlling the IGN power supply relay 14, and the smart entry control unit 3, which communicates with the portable unit 16 to authenticate the portable unit 16 and controls engine start. The engine start control system further includes the IGN power supply relay drive line A, which is not routed through the CPU 11, between the smart entry control unit 3 and the IGN power supply relay 14.

A method of controlling engine start of the first embodiment relates to the engine start control system 1 including the power supply control unit 2, which has the IGN power supply relay 14 and the CPU 11 controlling the IGN power supply relay 14, and the smart entry control unit 3, which communicates with the portable unit 16 to authenticate the portable unit 16 and controls engine start. In the engine start control method, the IGN power supply relay drive line A, which is not routed through the CPU 11, is provided between the smart entry control unit 3 and the IGN power supply relay 14. The IGN power supply relay drive line A is used when the power supply control unit 2 fails.

As described above, the engine start control system of the first embodiment employs a redundant structure, in which the IGN power supply relay 14 is controlled and driven through two systems. Even when the power supply control unit 2 fails, therefore, the IGN power supply relay 14 can be driven. Accordingly, the reliability of the IGN power supply relay 14 can be improved, and the influence on travel of the vehicle can be reduced.

The power supply control unit 2 also includes the ST power supply relay 15 controlled by the CPU 11. In the present invention, the ST power supply relay drive line B, which is not routed through the CPU 11, is provided between the smart entry control unit 3 and the ST power supply relay 15. In this manner, the engine start control system 1 employs a redundant structure, in which the ST power supply relay 15 is controlled and driven through two systems. Even when the power supply control unit 2 fails, therefore, the ST power supply relay 15 can be driven. Accordingly, the reliability of the ST power supply relay 15 can be improved, and the influence on travel of the vehicle can be reduced.

In the present invention, the engine start control system further includes the multiplex communication line C between the smart entry control unit 3 and the power supply control unit 2. The engine start control system also includes the ESCL mechanism 4 and the ESCL state detection switch 17. The power supply control unit 2 also controls the ESCL power supply relay 13. With this configuration, even when the power supply control unit 2 fails, the ESCL power supply of the ESCL mechanism 4 can be controlled by use of the multiplex communication line C so that the ESCL power supply is turned on in the cases where the IGN power supply is off, the ST power supply is off, the vehicle speed is 0 km/h, and the engine is stopped and in the other cases, is turned off.

(Second Embodiment)

Figure 2:
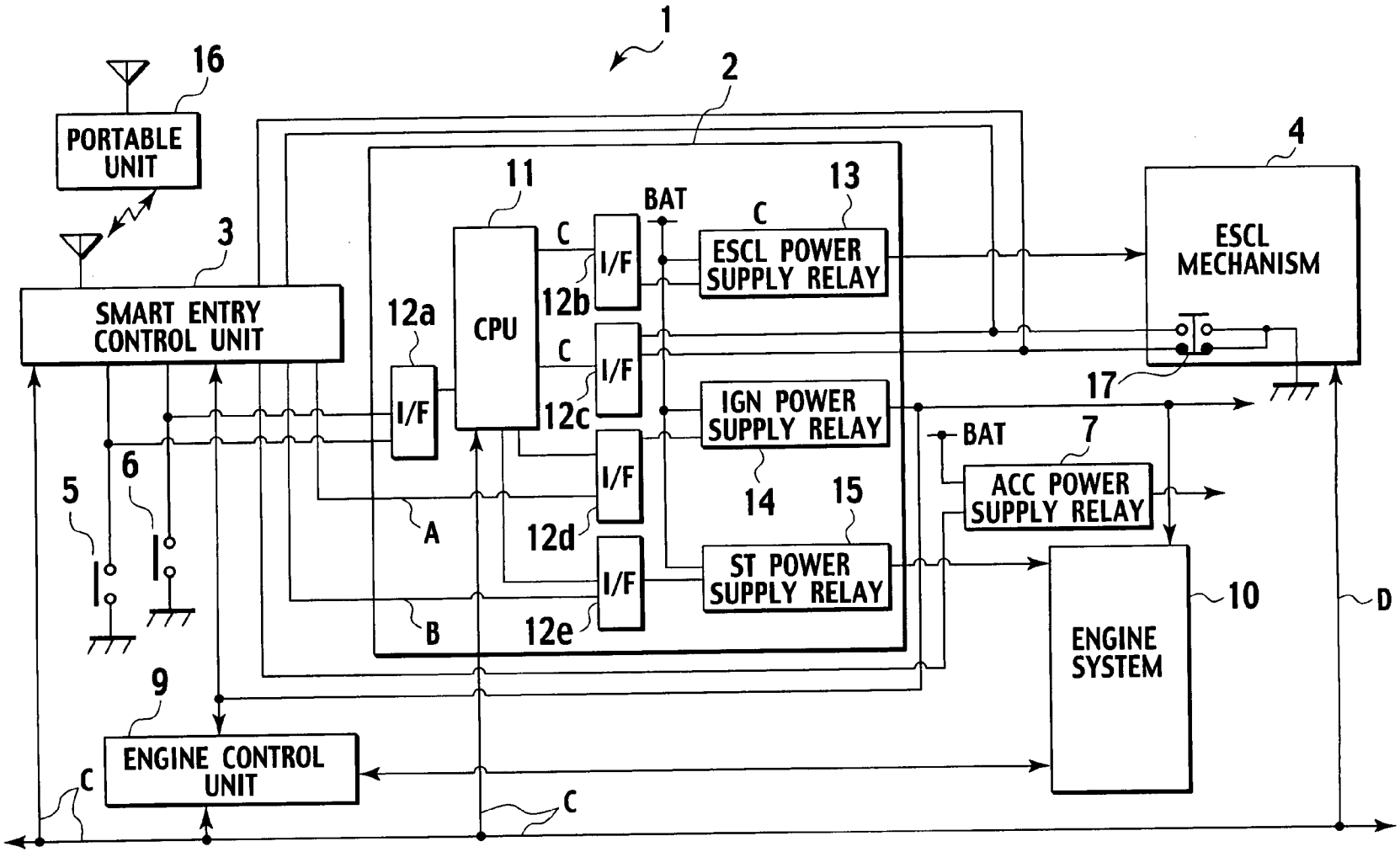
FIG. 2 is a diagram showing a system configuration of an engine start control system of a second embodiment of the present invention.

FIG. 2 shows a system configuration of an engine start control system of a second embodiment of the present invention.

A description is given of differences between the aforementioned first embodiment and the second embodiment. The engine start control system 1 of the second embodiment of the present invention, unlike the above first embodiment, includes a multiplex communication line D between the power supply control unit 2 and the ESCL mechanism 4. Such a configuration allows the ESCL mechanism 4 to acquire a signal from the multiplex communication line C through the multiplex communication line D. Even when any one of the portable unit 16, smart entry control unit 3, and engine control unit 9 fails, therefore, the ESCL mechanism 4 can work. In other words, the ESCL mechanism 4 can work by control using a switch signal input device connected to or incorporated in the engine start control system 1 without verification of the portable unit 16 by the smart entry control unit 3 as well as the IGN and ST power supply relays 14 and 15 can work. In this case, the control by the switch signal input device is performed according to signals of the engine on/off switch 5 and shift P range switch 6 of the power supply control unit 2. In the control by the switch signal input device, the IGN and ST power supply relays 14 and 15 and the ESCL mechanism 4 are operated according to the states of the aforementioned peripheral switches and the state of the signals on the multiplex communication line C.

The multiplex communication line D provided between the power supply control unit 2 and the ESCL mechanism 4 therefore allows travel of the vehicle. Moreover, it is possible to carry out fault diagnosis using a fault diagnosis device connected to or incorporated in the engine start control system 1. Consequently, the reliability of the vehicle can be improved, and speeding up troubleshooting and reduction in the number of renewal parts can reduce the repair cost.

The entire content of a Japanese Patent Application No. P2004-182020 with a filing date of Jun. 21, 2004 is herein incorporated by reference.

Although the invention has been described above by reference to certain embodiments of the invention, the invention is not limited to the embodiments described above will occur to these skilled in the art, in light of the teachings. The scope of the invention is defined with reference to the following claims.

What is claimed is:

1. An engine start control method, comprising:

preparing a power supply controller which includes an ignition power supply relay activating an electric component of a vehicle and a central processing unit controlling the ignition power supply relay, a communication device which communicates with a portable unit to authenticate a validity of the portable unit and performs engine start control, and a drive line which is provided between the communication device and the ignition power supply relay and is not routed through the central processing unit, and transmitting a signal to activate the electric component from the communication device to the ignition power supply relay using the drive line when the power supply controller fails.

2. An engine start control system, comprising:

power supply controlling means which includes: an ignition power supply relay activating an electric component of a vehicle; and a central processing unit controlling the ignition power supply relay;

communication means for communicating with a portable unit to authenticate a validity of the portable unit and performing engine start control; and a first drive line provided between the communication means and the ignition power supply relay and not routed through the central processing unit.

3. An engine start control system, comprising:

a power supply controller which includes: an ignition power supply relay activating an electric component of a vehicle; and a central processing unit controlling the ignition power supply relay;

a communication device communicating with a portable unit to authenticate a validity of the portable unit and performing engine start control; and a first drive line provided between the communication device and the ignition power supply relay and not routed through the central processing unit.

4. The engine start control system according to claim 3, wherein the power supply controller includes a starter power supply relay which supplies electric power to an engine system and is controlled by the central processing unit, and a second drive line not routed through the central processing unit is provided between the communication device and the starter power supply relay.

5. The engine start control system according to claim 3, further comprising:

a first multiplex communication line provided between the communication device and the power supply controller.

6. The engine start control system according to claim 3, further comprising:

an electric power steering lock device controlling locking or unlocking of an electric power steering column; and a steering lock state detection device detecting a state of a lock rod with which the electric power steering column is locked or unlocked, wherein the power supply controller controls a steering lock power supply relay connected to the central processing unit and the electric power steering lock device.

7. The engine start control system according to claim 3, further comprising:

a second multiplex communication line provided between the power supply controller and the electric power steering lock device.

* * * * *